US008205768B2

(12) United States Patent
Shiffer

(10) Patent No.: US 8,205,768 B2
(45) Date of Patent: Jun. 26, 2012

(54) CONTAINER LID AND ASSOCIATED ASSEMBLY

(75) Inventor: Gerald A. Shiffer, Urbana, OH (US); David A. Shiffer, legal representative, Irwin, OH (US)

(73) Assignee: Tech II, Inc., Springfiled, OH (US)

( * ) Notice: Subject to any disclaimer, the term of this patent is extended or adjusted under 35 U.S.C. 154(b) by 593 days.

(21) Appl. No.: 11/599,000

(22) Filed: Nov. 14, 2006

(65) Prior Publication Data

US 2007/0114236 A1 May 24, 2007

Related U.S. Application Data

(60) Provisional application No. 60/737,463, filed on Nov. 15, 2005.

(51) Int. Cl.
*B65D 41/16* (2006.01)

(52) U.S. Cl. ..... 220/780; 220/713; 229/906.1

(58) Field of Classification Search ..... 220/254.1, 220/780, 782, 713; 229/404, 906.1; 215/200, 215/316

See application file for complete search history.

(56) References Cited

U.S. PATENT DOCUMENTS

| | | | | |
|---|---|---|---|---|
| 3,381,872 | A | 5/1968 | Holder et al. | |
| 3,566,946 | A | 3/1971 | MacDonald | |
| 3,902,619 | A | 9/1975 | Gouget | |
| 4,026,459 | A * | 5/1977 | Blanchard | 229/404 |
| 4,043,482 | A | 8/1977 | Brown | |
| 4,180,179 | A | 12/1979 | Hoenig et al. | |
| 4,244,920 | A | 1/1981 | Manschot et al. | |
| 4,426,014 | A | 1/1984 | Coltman, Jr. | |
| 4,449,641 | A | 5/1984 | Jorgensen et al. | |
| 4,453,647 | A | 6/1984 | Neat | |
| 4,467,938 | A | 8/1984 | Allen | |
| 4,512,493 | A | 4/1985 | Von Holdt | |
| 4,840,289 | A | 6/1989 | Fait et al. | |
| 4,887,735 | A | 12/1989 | Dudzik | |
| D320,560 | S | 10/1991 | Allen | |
| 5,125,530 | A | 6/1992 | Straub | |
| 5,437,386 | A | 8/1995 | Von Holdt | |
| 5,573,134 | A | 11/1996 | Chenault et al. | |
| 2003/0024930 | A1 * | 2/2003 | Smith et al. | 220/254.1 |
| 2004/0118847 | A1 * | 6/2004 | Giraud | 220/254.3 |
| 2006/0243734 | A1 * | 11/2006 | Tedford, Jr. | 220/780 |

FOREIGN PATENT DOCUMENTS

| | | |
|---|---|---|
| GB | 2 227 481 | 8/1990 |

* cited by examiner

*Primary Examiner* — Anthony Stashick
*Assistant Examiner* — Jeffrey Allen
(74) *Attorney, Agent, or Firm* — Maginot, Moore & Beck

(57) ABSTRACT

A lid and container assembly includes a container having a rim portion that defines a container opening, and a lid having (i) a cover portion positioned over the container opening, and (ii) a skirt extending from the cover portion and positioned circumferentially around the rim portion. The skirt defines an interior facing surface and an exterior facing surface. The skirt includes a sealing band extending from the interior facing surface positioned in contact with the rim portion. The sealing band defines a vertex along the extent of the sealing band. The vertex possesses (i) a first height at a first circumferential position of the sealing band, and (ii) a second height at a second circumferential position of the sealing band. The second height is greater than the first height. Height of the vertex asymptotically increases as the sealing band extends from the first circumferential position to the second circumferential position.

38 Claims, 10 Drawing Sheets

CONTAINER LID AND ASSOCIATED ASSEMBLY

This application claims the benefit of U.S. Provisional Application Ser. No. 60/737,463, filed Nov. 15, 2005. The disclosure of this provisional patent application is hereby totally incorporated by reference in its entirety.

BACKGROUND

This invention relates to the field of lids, containers, and associated assemblies. In particular, this invention relates to lids, containers, and associated assemblies which are configured to contain beverages such as soup. This invention further relates to lids, containers, and associated assemblies which are configured to undergo heating in a microwave appliance whereby liquid in the container is heated for subsequent consumption by a consumer.

It would be advantageous to provide a lid, container, and associated assembly that allow a user to drink liquid contained in the container, while including an improved seal to prevent liquid from leaking at the lid-container interface during the drinking process, especially after the liquid and the lid and container were heated in a microwave appliance. In addition, it would be advantageous to provide such a lid that may be easily removed from the container by the user.

DESCRIPTION

Figure 1:
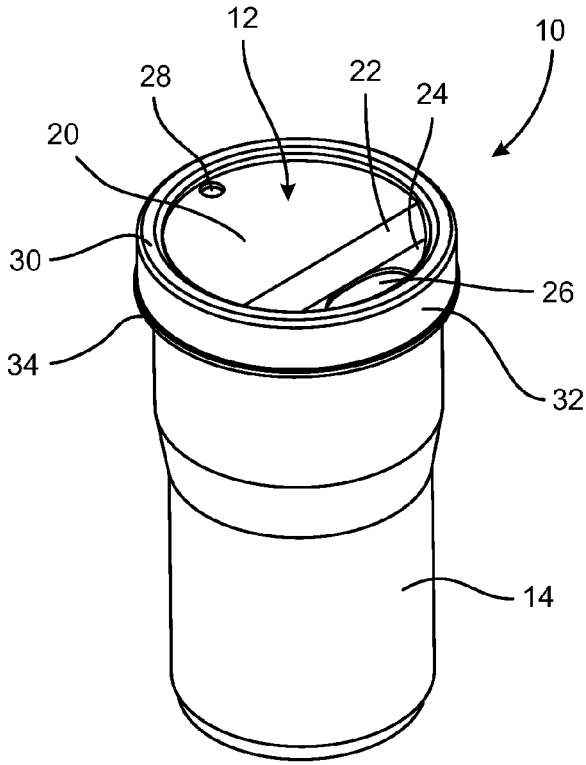
FIG. 1 shows a perspective view of a lid and container assembly of a first embodiment of the present disclosure.

With reference to FIG. 1, there is shown an assembly 10 that includes a lid 12 and a container 14. The lid 12 is shown positioned on and attached to the container 14 in FIG. 1. The container 14 is configured to retain a liquid. The liquid may be a food item such as soup or coffee. The lid 12 is configured to allow the liquid to escape from the container 14 without removal of the lid from the container. The lid is comprised of a semi-rigid polymer material.

Figure 2:
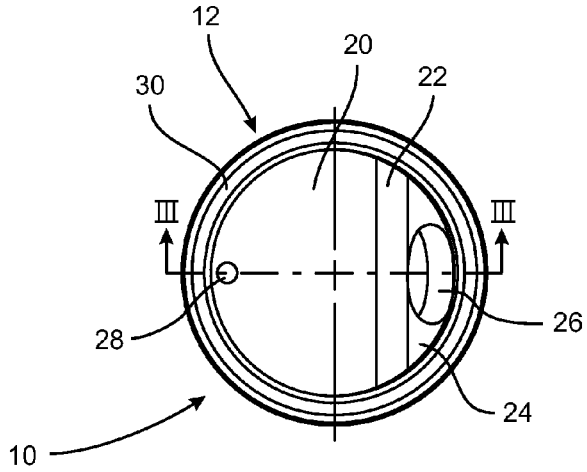
FIG. 2 shows a top elevational view of the lid and container assembly of FIG. 1.

The lid 12 comprises a face 20 defined within an upper lid rim 30. The face is generally flat with an angled portion 22 that leads to a depression 24. A drink hole 26 is formed in the depression 24 of the face. The drink hole 26 is designed and dimensioned to allow liquid contained within the container 14 to pass through the drink hole 26 when the container is tipped. A vent hole 28 is positioned on the face 20 of the lid 12 opposite the drink hole 26. The vent hole 28 is designed and dimensioned to allow air to flow into the container 14 as the contents of the container are expelled through the drink hole 26. Note that the drink hole 26 is larger than the vent hole 28 as shown in FIGS. 1 and 2.

Figure 3:
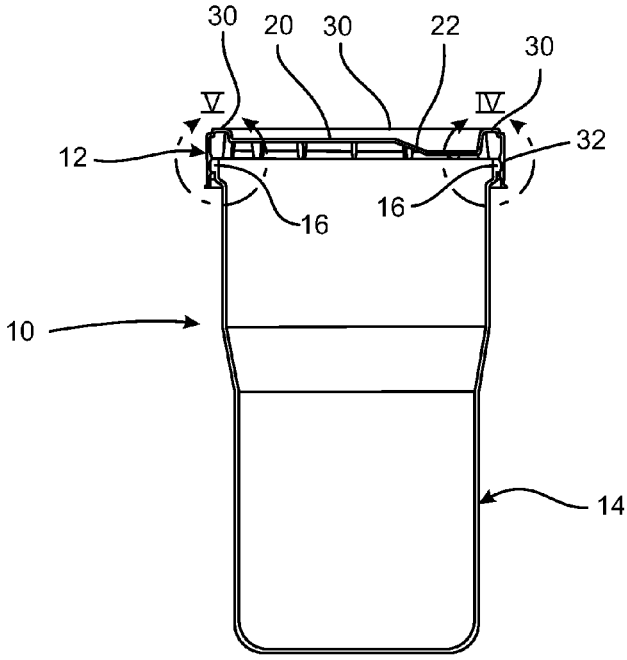
FIG. 3 shows a cross-sectional view of the lid and container assembly taken along the line III-III of FIG. 2.
Figure 4:
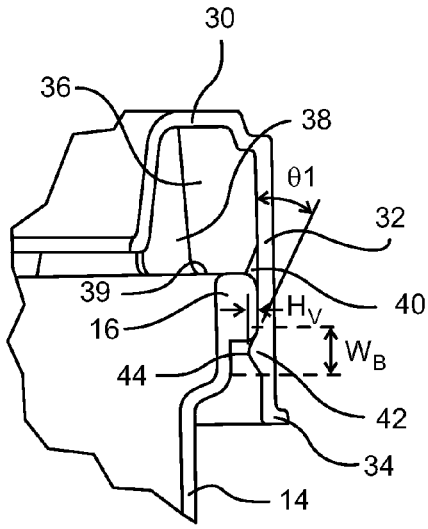
FIG. 4 shows an enlarged fragmentary view of the lid and container assembly near circular line IV of FIG. 3.
Figure 5:
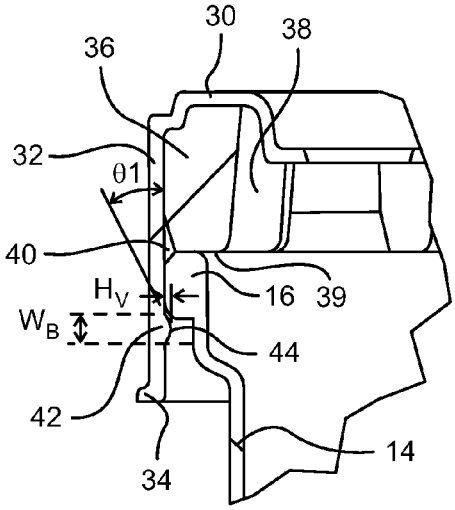
FIG. 5 shows an enlarged fragmentary view of the lid and container assembly near circular line V of FIG. 3.

The lid 12 further comprises a skirt 32 that depends from the upper lid rim 30. The skirt 32 is configured to assume a ring-like shape. As shown in FIGS. 3-5, the skirt 32 extends down from the upper lid rim 30 and surrounds a top rim 16 of the container 14 when the lid 12 is seated on the container 14. The skirt 32 terminates in a lower lip 34 of the lid 12. The upper rim 30 and the depending skirt 32 of the lid 12 form a circumferential channel 36 that extends around the lid just under the upper rim 30. A plurality of ribs 38 are positioned in the channel. Each rib 38 includes a shoulder 39 designed to contact the top rim 16 of the container when the lid 12 is seated on the container. The ribs 38 also provide structural support for the upper portion of the lid 12.

Figure 9:
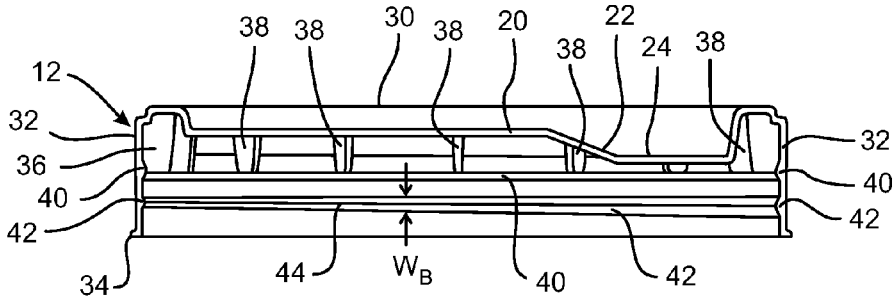
FIG. 9 shows an enlarged cross-sectional view of the lid of FIG. 1.

With reference to FIGS. 4, 5, and 9, an upper band 40 and a lower band 42 are positioned on an interior facing surface of the skirt 32. Both the upper band 40 and the lower band 42 protrude inwardly from the interior facing surface of the skirt 32 and extend circumferentially around the skirt. The upper band 40 is positioned along the shoulder portions 39 of the ribs 38. The lower band 42 is positioned parallel with the upper band 40 at a distance below the upper band 40. As best seen in FIGS. 4 and 5, the upper band 40 and lower band 42 are positioned a sufficient distance apart such that the top rim 16 of the container 14 will fit between the upper band 40 and the lower band 42.

As shown in FIGS. 4 and 5, the lower band 42 of the lid 14 extends radially inward from the inside surface of the skirt 32. The lower band 42 includes two opposing sides that extend away from the surface of the skirt 32 at an angle θ1 and meet at a vertex 44. The vertex 44 provides the furthest distance the band 42 extends from the skirt 32 at any given point on the band 42. The distance from the skirt 32 to the vertex 44 of the lower band 42 is defined by distance $H_V$ in FIGS. 4 and 5. The band also has a vertical width defined by distance $W_B$ in FIGS. 4 and 5.

Figure 6:
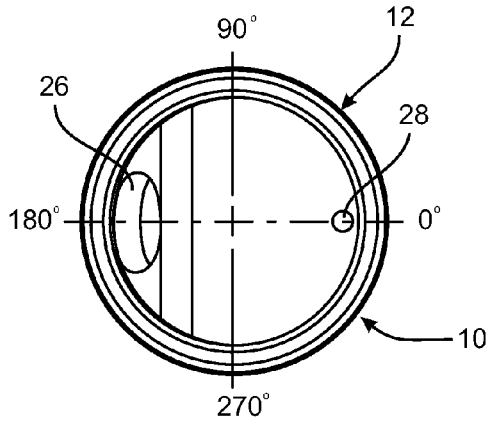
FIG. 6 shows a top elevational view of the lid of FIG. 1 indicating radial positions on the skirt of the lid.
Figure 7:
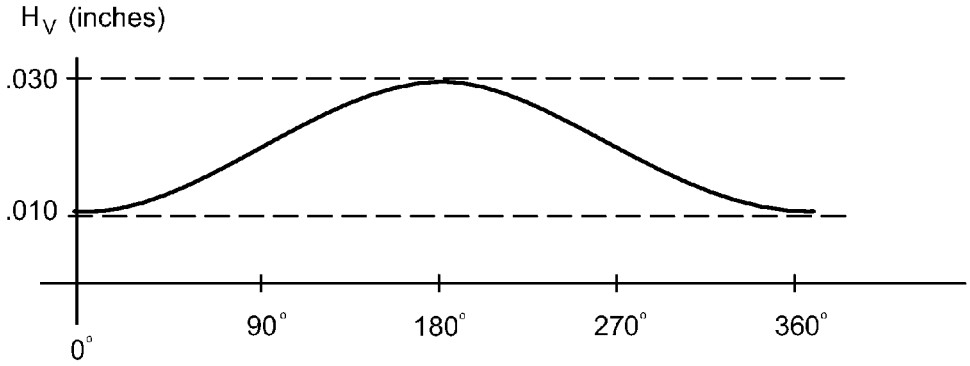
FIG. 7 shows a graph of the vertex depth or height of a lower band on the lid at various radial positions of FIG. 6

With reference to FIGS. 6 and 7, the distance $H_V$ of the vertex 44 from the skirt 32 (i.e., the "height" of the vertex or the "height" of the band) is variable or non-uniform over the length of the lower band 42. In particular, the vertex 44 has a relatively small "height" $H_V$ on the vent hole 28 side of the lid 12, but has a much greater "height" $H_V$ on the drink hole 26 side of the lid 12. For example, in the embodiment shown in FIG. 7, the vertex 44 only extends between 0.005 inches to 0.015 inches (and preferably 0.010 inches) outward from the surface of the skirt 32 at angular or circumferential position 0°. However, as the band 42 is formed circumferentially around the skirt of the lid, the vertex 44 extends further and further away from the surface of the skirt 32, until at angular position 180°, the vertex is between 0.025 inches and 0.035 inches (and preferably 0.030 inches) away from the surface of the skirt. From this position the vertex gradually decreases and moves closer to the surface of the skirt until the vertex returns to between 0.005 inches and 0.015 inches (and preferably 0.010 inches) at angular position 0°.

Figure 8:
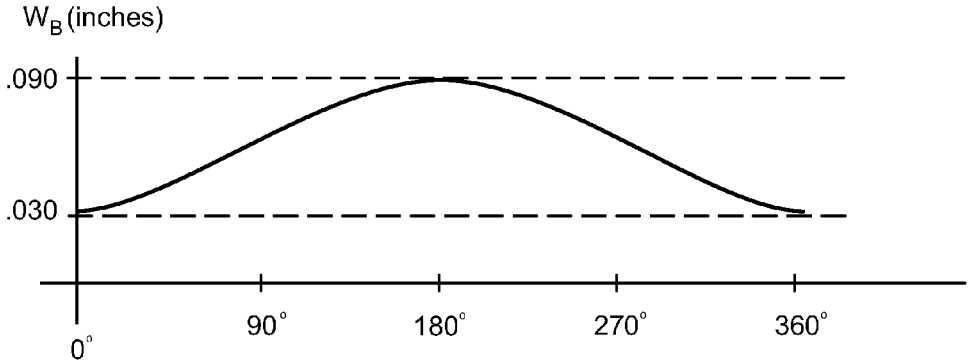
FIG. 8 shows a graph of the width of the lower band at various radial positions of FIG. 6.

Similar to the variation in the distance $H_V$ from the vertex 44 of the lower band 42 to the skirt 32, the vertical width $W_B$ of the lower band also changes based on the angular or circumferential position of the band 42. In particular, with reference to FIGS. 6 and 8, the width $W_B$ of the band 42 is relatively small near the vent hole 28 portion of the lid, but is larger near the drink hole 26 portion of the lid. For example, in the embodiment shown in FIG. 8, the width $W_B$ of the band 42 is between 0.025 inches and 0.035 inches (and preferably 0.030 inches) at angular position 0°. The width $W_B$ of the band 42 then gradually increases until it reaches between 0.085 inches and 0.095 inches (and preferably 0.090 inches) at angular position 180°. Thereafter, the width $W_B$ of the band gradually decreases back to between 0.025 inches and 0.035 inches (and preferably 0.030 inches) at angular position 0°. This gradual increase in the width of the band is also shown in FIG. 9 where the lower band 44 is shown as gradually increasing in width $W_B$ from the vent hole side of the lid to the drink hole side of the lid.

Figure 10:
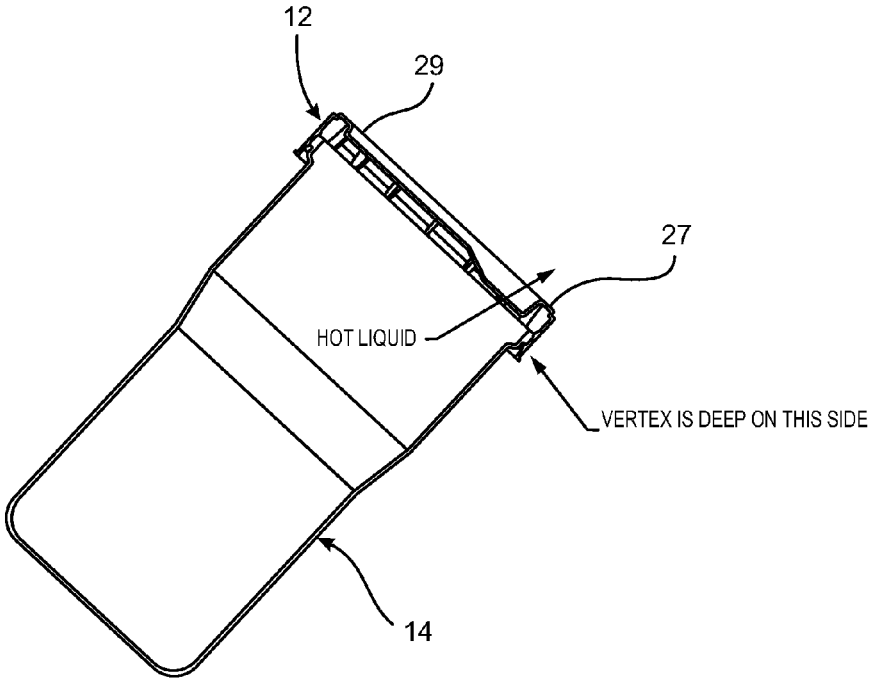
FIG. 10 shows a cross-sectional view of the lid and container assembly taken along the line III-III of FIG. 2, but showing the assembly in a tilted orientation as would be assumed when a consumer tilts the assembly in order to expel liquid from the assembly into a mouth of the consumer.

The variable size of the lower band 42, including varying band width $W_B$ and varying band height $H_V$ provide several advantages. For example, as best seen in FIG. 4, when the height $H_V$ of the lower band 42 and the width $W_B$ of the band are greatest, the top rim 16 of the container 14 snugly fits between the upper band 40 and the lower band 42. This snug fit between the top rim 16 of the container and the upper band 40 and the lower band 42 of the lid helps to prevent any liquid from passing between the top rim 16 of the container 14 and the lid 12 when the container 14 is tipped toward the drink hole side 27 as shown in FIG. 10, especially after the assembly 10 and liquid contained therein had just been heated in a microwave appliance. Therefore, the assembly 10 provides the advantage of improved leak protection when the container 14 is tipped by a user for drinking liquid from the drink hole of the lid.

An example of an additional advantage provided by the lid 12 described herein is that because the height $H_V$ and width $W_B$ of the lower band 42 are lesser on the vent hole side 29 of the lid 12, the lid 12 is easier to remove from the container 14 on this side of the lid. In particular, a less restrictive fit is provided between the top rim 16 of the container 14 and the upper and lower bands 40 and 42 for the portion of the lid 12 shown in FIG. 5 when compared to the relatively snug fit shown in FIG. 4. In addition, the profile of the lower band 42 is smaller in FIG. 5, facilitating passage of the top rim 16 of the container 14 past the lower band 42 of the lid 12. Thus, a user may be instructed to remove the lid 12 from the container 14 on the vent hole side 29 of the container. By following these instructions, the user will have a relatively easy time removing the lid 12 from the container 14, as the lower band 42 of the lid will more easily pass by the top rim on the vent side 29 of the lid.

Although the embodiment described with regarding to FIGS. 1-10 is a preferred embodiment, it will be appreciated by those of skill in the art that other implementations and adaptations are possible. For example, the change in the height and width of the lower band need not conform to the sinusoidal form shown in FIGS. 7 and 8. The change in the band may, for example, be more abrupt such that FIGS. 7 and 8 resemble a square wave form. Furthermore, in one embodiment, the lower band may be non-existent on the vent hole side of the lid. In such an embodiment, FIGS. 7 and 8 would show the height and width of the lower band as zero at some circumferential portion of the band closer to 0° (e.g., from 270° down to 0° and up to 90°).

Figure 11:
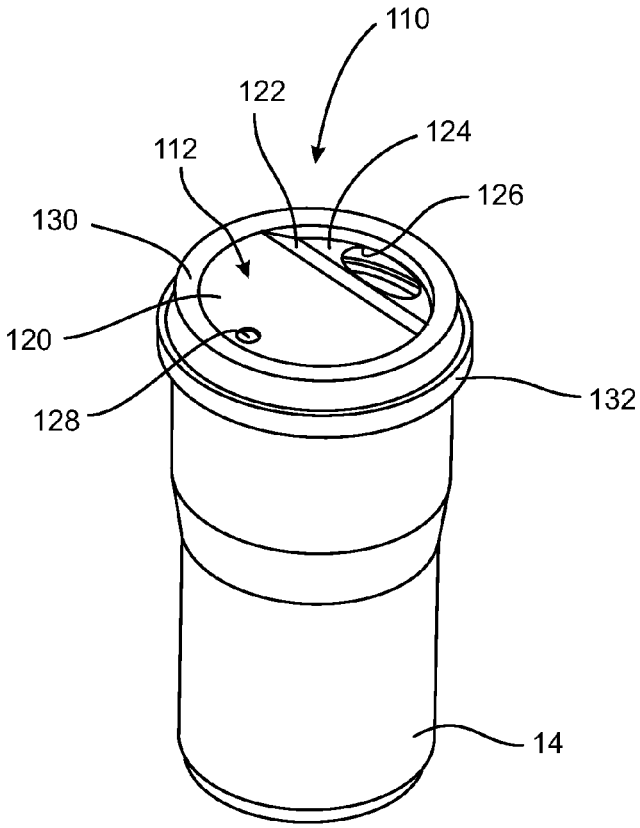
FIG. 11 shows a perspective view of a lid and container assembly of a second embodiment of the present disclosure.

Referring now to FIG. 11, there is shown another assembly 110 that includes a lid 112 and a container 114. The lid 112 is shown positioned on and attached to the container 114. The container 114 is configured to retain a liquid. The liquid may be a food item such as soup or coffee. The lid 112 is configured to allow the liquid to escape from the container 114 without removal of the lid from the container. The lid is comprised of a semi-rigid polymer material.

Figure 12:
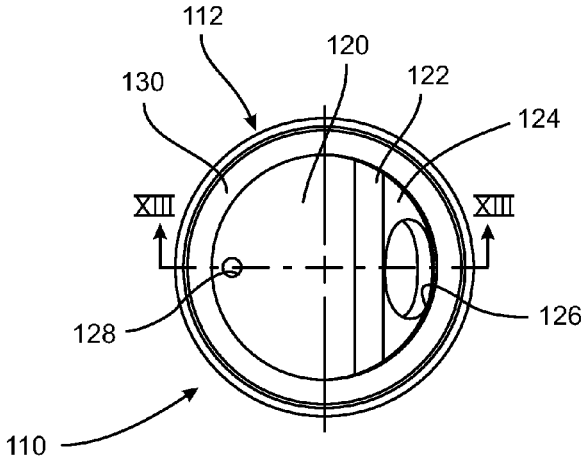
FIG. 12 shows a top elevational view of the lid and container assembly of FIG. 11.

The lid 112 comprises a face 120 defined within an upper lid rim 130. The face is generally flat with an angled portion 122 that leads to a depression 124. A drink hole 126 is formed in the depression 124 of the face. The drink hole 126 is designed and dimensioned to allow liquid contained within the container 114 to pass through the drink hole 126 when the container is tipped. A vent hole 128 is positioned on the face 120 of the lid 112 opposite the drink hole 126. The vent hole 128 is designed and dimensioned to allow air to flow into the container 114 as the contents of the container are expelled through the drink hole 126. Note that the drink hole 126 is larger than the vent hole 128 as shown in FIGS. 11 and 12.

Figure 13:
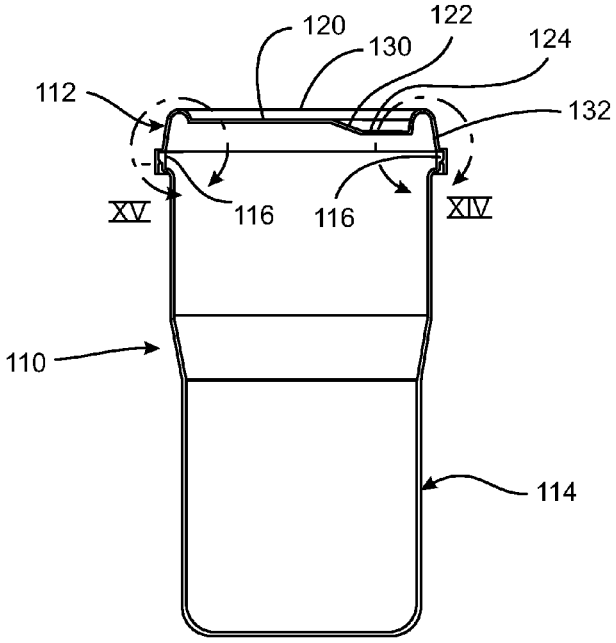
FIG. 13 shows a cross-sectional view of the lid and container assembly taken along the line XIII-XIII of FIG. 12.
Figure 14:
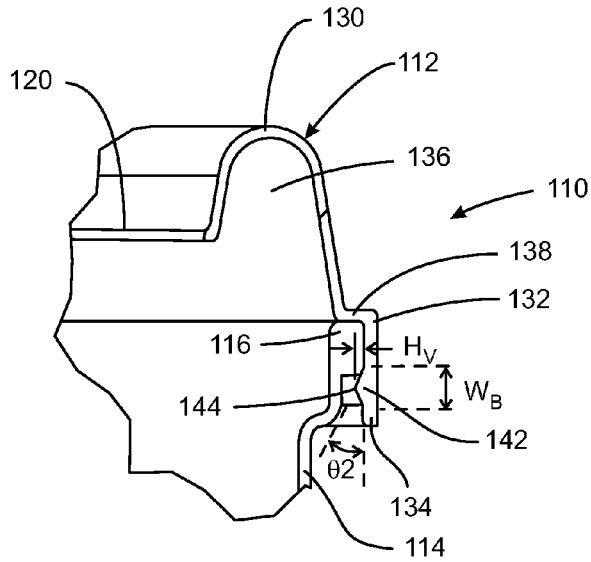
FIG. 14 shows an enlarged fragmentary view of the lid and container assembly near circular line XIV of FIG. 13.
Figure 15:
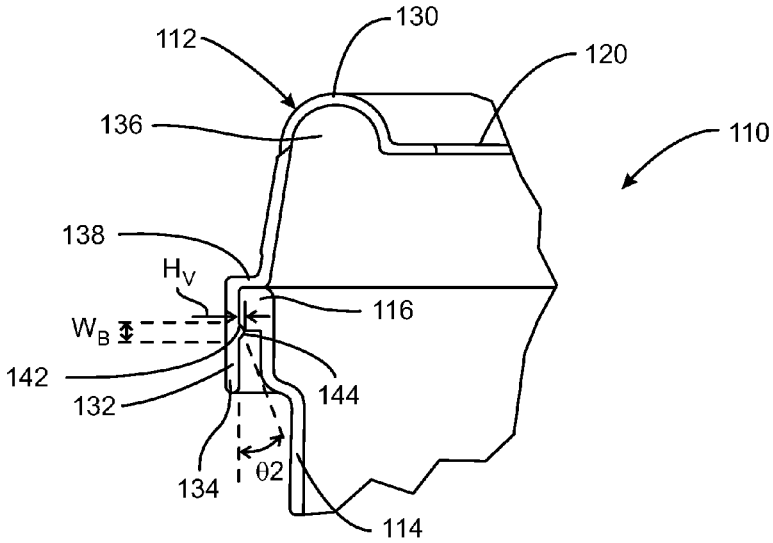
FIG. 15 shows an enlarged fragmentary view of the lid and container assembly near circular line XV of FIG. 13.

The lid 112 further comprises a skirt 132 that depends from the upper lid rim 130. The skirt 132 is configured to assume a generally ring-like shape. As shown in FIGS. 13-15, the skirt 132 extends down from the upper lid rim 130 and surrounds the top rim 116 of the container 114 when the lid 112 is seated on the container 114. The skirt 132 terminates in a lower lip 134 of the lid 112. The upper rim 130 and the depending skirt 132 of the lid 112 form a circumferential channel 136 that extends around the lid just under the upper rim 130. The skirt 132 is configured to define a shoulder 138 (see FIGS. 14 and 15) that is designed to contact the top rim 116 of the container 114 when the lid 112 is seated on the container.

Figure 19:
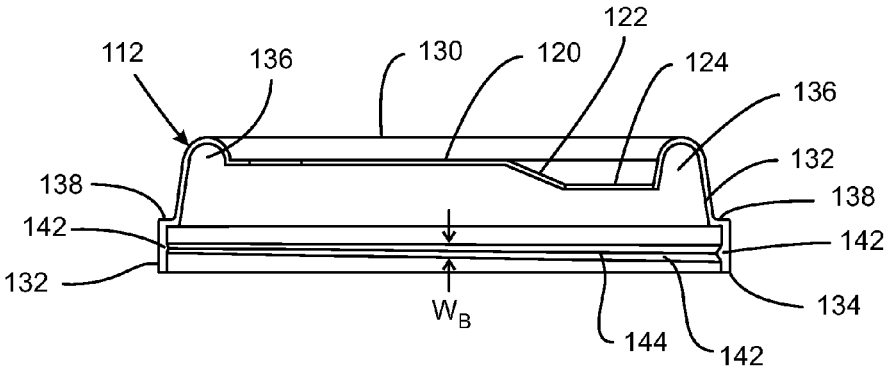
FIG. 19 shows an enlarged cross-sectional view of the lid of FIG. 11.

With reference to FIGS. 14, 15, and 19, a band 142 is positioned on an interior facing surface of the skirt 132. The band 142 protrudes inwardly from the interior facing surface of the skirt 132 and extends circumferentially around the skirt. The band 142 is positioned parallel with the shoulder 138 of the skirt at a distance below the shoulder 138. As best seen in FIGS. 14 and 15, the shoulder 138 and the band 142 are positioned a sufficient distance apart such that the top rim 116 of the container 114 will fit between the shoulder 138 and the band 142.

As shown in FIGS. 14 and 15, the band 142 of the lid 114 extends radially inward from the interior facing surface of the skirt 132. The band 142 includes two opposing sides that extend away from the interior facing surface of the skirt 132 at an angle θ2 and meet at a vertex 144. The vertex 144 provides the furthest distance the band 142 extends from the skirt 132 at any given point on the band 142. The distance from the skirt 132 to the vertex 144 of the band 142 is defined by distance $H_V$ in FIGS. 14 and 15. The band 142 also has a vertical width defined by distance $W_B$ in FIGS. 14 and 15.

Figure 16:
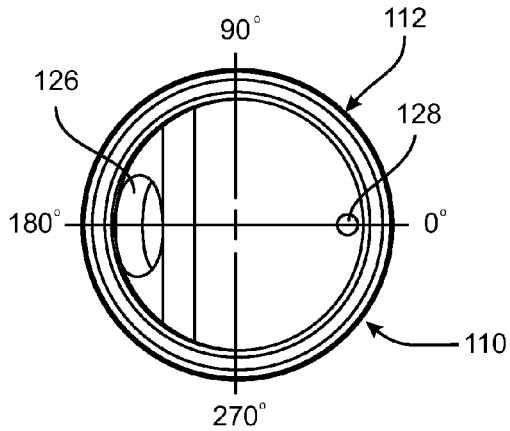
FIG. 16 shows a top elevational view of the lid of FIG. 11 indicating radial positions on the skirt of the lid.
Figure 17:
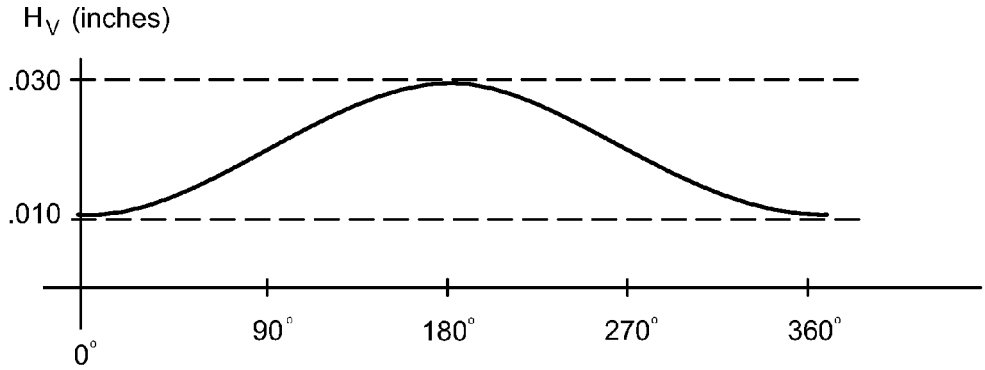
FIG. 17 shows a graph of the vertex depth or height of a lower band on the lid at various radial positions of FIG. 16.

With reference to FIGS. 16 and 17, the distance $H_V$ of the vertex 144 from the skirt 132 (i.e., the "height" of the vertex or the "height" of the band) is variable or non-uniform over the length of the band 142. In particular, the vertex 144 has a relatively small "height" $H_V$ on the vent hole 128 side of the lid 12, but has a much greater "height" $H_V$ on the drink hole 126 side of the lid 112. For example, in the embodiment shown in FIG. 17, the vertex 144 only extends between 0.005 inches to 0.015 inches (and preferably 0.010 inches) outward from the surface of the skirt 132 at angular or circumferential position 0°. However, as the band 142 is formed circumferentially around the skirt of the lid, the vertex 144 extends further and further away from the surface of the skirt 132, until at angular position 180°, the vertex is between 0.025 inches and 0.035 inches (and preferably 0.030 inches) away from the surface of the skirt. From this position the vertex gradually decreases and moves closer to the surface of the skirt until the vertex returns to between 0.005 inches and 0.015 inches (and preferably 0.010 inches) at angular position 0°.

Figure 18:
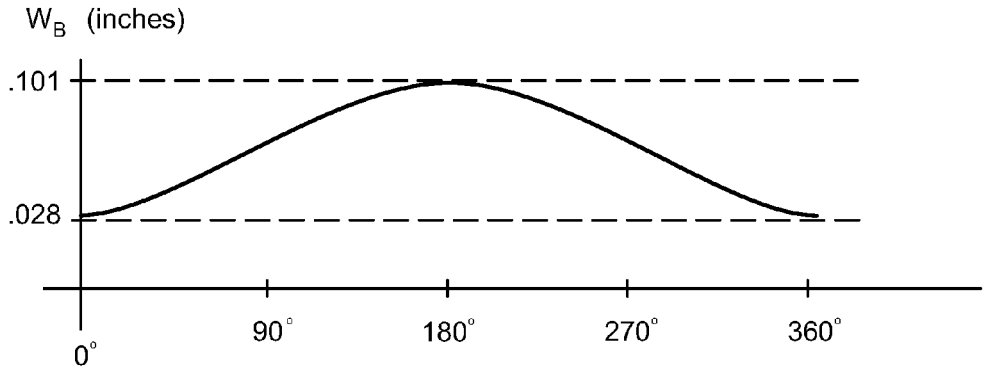
FIG. 18 shows a graph of the width of the lower band at various radial positions of FIG. 16.

Similar to the variation in the distance $H_V$ from the vertex 144 of the lower band 142 to the skirt 132, the vertical width $W_B$ of the lower band also changes based on the angular or circumferential position of the band 142. In particular, with reference to FIGS. 16 and 18, the width $W_B$ of the band 142 is relatively small near the vent hole 128 portion of the lid, but is larger near the drink hole 126 portion of the lid. For example, in the embodiment shown in FIG. 18, the width $W_B$ of the band 142 is between 0.023 inches and 0.033 inches (and preferably 0.028) inches at angular position 0°. The width $W_B$ of the band 42 then gradually increases until it reaches between 0.096 inches and 0.106 inches (and preferably 0.101 inches) at angular position 180°. Thereafter, the width $W_B$ of the band gradually decreases back to between 0.023 inches and 0.033 inches (and preferably 0.028 inches) at angular position 0°. This gradual increase in the width of the band is also shown in FIG. 19 where the band 144 is shown as gradually increasing in width $W_B$ from the vent hole side of the lid to the drink hole side of the lid.

Figure 20:
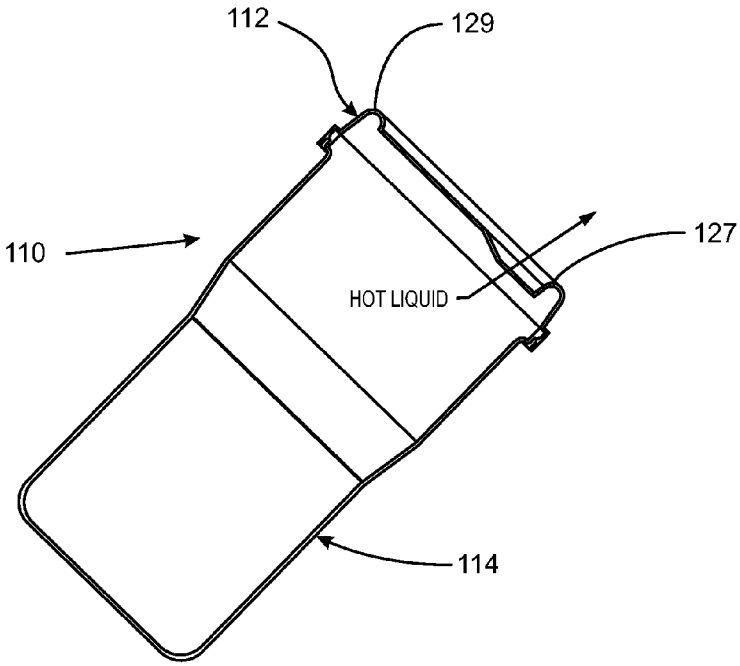
FIG. 20 shows a cross-sectional view of the lid and container assembly taken along the line XIII-XIII of FIG. 12, but showing the assembly in a tilted orientation as would be assumed when a consumer tilts the assembly in order to expel liquid from the assembly into a mouth of the consumer.

The variable size of the band 142, including varying band width $W_B$ and varying band height $H_V$ provide several advantages. For example, as best seen in FIG. 14, when the height $H_V$ of the band 142 and the width $W_B$ of the band are greatest, the top rim 116 of the container 114 snugly fits between the shoulder 138 and the band 142. This snug fit of the top rim 116 of the container between the shoulder 138 and the band 142 of the lid helps to prevent any liquid from passing between the top rim 116 of the container 114 and the lid 112 when the container 114 is tipped toward the drink hole side 127 as shown in FIG. 20, especially after the assembly 20 and liquid contained therein had just been heated in a microwave appliance. Therefore, the assembly 110 provides the advantage of improved leak protection when the container 114 is tipped by a user for drinking liquid from the drink hole of the lid 112.

An example of an additional advantage provided by the lid 112 described herein is that because the height $H_V$ and width $W_B$ of the band 142 are lesser on the vent hole side 129 of the lid 112, the lid 112 is easier to remove from the container 114 on this side of the lid. In particular, a less restrictive fit is provided between the top rim 116 of the container 114 and the shoulder 138 and band 142 for the portion of the lid 112 shown in FIG. 15 when compared to the relatively snug fit shown in FIG. 14. In addition, the profile of the band 142 is smaller in FIG. 15, facilitating passage of the top rim 116 of the container 114 past the band 142 of the lid 112. Thus, a user may be instructed to remove the lid 112 from the container 114 on the vent hole side 129 of the container. By following these instructions, the user will have a relatively easy time removing the lid 112 from the container 114, as the band 142 of the lid will more easily pass by the top rim on the vent side 129 of the lid.

Although the embodiment described with regarding to FIGS. 11-20 is another preferred embodiment, it will be appreciated by those of skill in the art that other implementations and adaptations are possible. For example, the change in the height and width of the lower band need not conform to the sinusoidal form shown in FIGS. 17 and 18. The change in the band may, for example, be more abrupt such that FIGS. 17 and 18 resemble a square wave form. Furthermore, in one embodiment, the band 142 may be non-existent on the vent hole side of the lid. In such an embodiment, FIGS. 17 and 18 would show the height and width of the band 142 as zero at some circumferential portion of the band closer to 0° (e.g., from 270° down to 0° and up to 90°).

It should be appreciated that there are advantages to individual advancements described herein that may be obtained without incorporating other aspects described above. Therefore, the invention should not be limited to the description of the preferred embodiments contained herein.

What is claimed is:

1. A lid and container assembly, comprising:

a container having a rim portion that defines a container opening; and a lid having (i) a cover portion positioned over said container opening, and (ii) a skirt, wherein said skirt includes (i) a skirt body extending from said cover portion and positioned circumferentially around said rim portion of said container so as to define a skirt body space in which said rim portion of said container is located, and (ii) a sealing band secured to said skirt body and located in said skirt body space, wherein said skirt body defines an interior facing surface and an exterior facing surface, wherein said sealing band extends inwardly from said interior facing surface of said skirt body and is positioned in contact with said rim portion of said container, wherein said sealing band defines a vertex along the extent of said sealing band and said sealing band extends 360° so as to completely encircle said rim portion of said container, wherein said vertex possesses (i) a first height at a first circumferential position of said sealing band, and (ii) a second height at a second circumferential position of said sealing band, wherein said second height is greater than said first height, and wherein height of said vertex asymptotically increases as said sealing band extends from said first circumferential position to said second circumferential position.

2. The assembly of claim 1, wherein:

said vertex possesses a third height at a third circumferential position of said sealing band which is spaced apart from said first circumferential position, said second height is greater than said third height, and height of said vertex asymptotically decreases as said sealing band extends from said second circumferential position to said third circumferential position.

3. The assembly of claim 1, wherein:

said first height of said vertex is a minimum height of said vertex, and said second height of said vertex is a maximum height of said vertex.

4. The assembly of claim 3, wherein:

0.005 inches<said minimum height of said vertex<0.015 inches, and 0.025 inches<said maximum height of said vertex<0.035 inches.

5. The assembly of claim 4, wherein:

said minimum height of said vertex is equal to about 0.010 inches, and said maximum height of said vertex is equal to about 0.030 inches.

6. The assembly of claim 3, wherein:

said cover portion defines (i) a first opening, and (ii) a second opening that is larger than said first opening, said first opening is aligned with said first circumferential position of said sealing band, and said second opening is aligned with said second circumferential position of said sealing band.

7. The assembly of claim 1, wherein:

said sealing band defines a width along the extent of said sealing band as said sealing band extends around at least said part of said rim portion of said container, said width possesses a first magnitude at said first circumferential position of said sealing band, said width possesses a second magnitude at said second circumferential position of said sealing band, said second magnitude is greater than said first magnitude, and said width asymptotically increases as said sealing band extends from said first circumferential position to said second circumferential position.

8. The assembly of claim 7, wherein:

said width possesses a third magnitude at a third circumferential position of said sealing band which is spaced apart from said first circumferential position, said second magnitude is greater than said third magnitude, and magnitude of said width asymptotically decreases as said sealing band extends from said second circumferential position to said third circumferential position.

9. The assembly of claim 7, wherein:

said first magnitude of said width is a minimum width of said sealing band, and said second magnitude of said width is a maximum width of said sealing band.

10. The assembly of claim 9, wherein:

0.023 inches<said minimum width of said sealing band<0.035 inches, and 0.085 inches<said maximum width of said sealing band<0.106 inches.

11. The assembly of claim 10, wherein:

said minimum width of said sealing band is equal to about 0.030 inches, and said maximum width of said sealing band is equal to about 0.101 inches.

12. The assembly of claim 7, wherein:

said cover portion defines (i) a first opening, and (ii) a second opening that is larger than said first opening, said first opening is aligned with said first circumferential position of said sealing band, and said second opening is aligned with said second circumferential position of said sealing band.

13. A lid adapted for use with a container having a rim portion that defines a container opening, comprising:

a cover portion, and a skirt including (i) a skirt body extending from said cover portion and defining a skirt body space configured to receive said rim portion of said container therein, and (ii) a sealing band located in said skirt body space, wherein said skirt body defines an interior facing surface and an exterior facing surface, wherein said sealing band is attached to said interior facing surface and extends 360° along said interior facing surface, wherein said sealing band defines a vertex along the extent of said sealing band as said sealing band extends along at least a part of said interior facing surface of said skirt, wherein said vertex possesses (i) a first height at a first circumferential position of said sealing band, and (ii) a second height at a second circumferential position of said sealing band, wherein said second height is greater than said first height, and wherein height of said vertex asymptotically increases as said sealing band extends from said first circumferential position to said second circumferential position.

14. The assembly of claim 13, wherein:

said vertex possesses a third height at a third circumferential position of said sealing band which is spaced apart from said first circumferential position, said second height is greater than said third height, and height of said vertex asymptotically decreases as said sealing band extends from said second circumferential position to said third circumferential position.

15. The assembly of claim 13, wherein:

said first height of said vertex is a minimum height of said vertex, and said second height of said vertex is a maximum height of said vertex.

16. The assembly of claim 15, wherein:

0.005 inches<said minimum height of said vertex<0.015 inches, and 0.025 inches<said maximum height of said vertex<0.035 inches.

17. The assembly of claim 16, wherein:

said minimum height of said vertex is equal to about 0.010 inches, and said maximum height of said vertex is equal to about 0.030 inches.

18. The assembly of claim 15, wherein:

said cover portion defines (i) a first opening, and (ii) a second opening that is larger than said first opening, said first opening is aligned with said first circumferential position of said sealing band, and said second opening is aligned with said second circumferential position of said sealing band.

19. The assembly of claim 13, wherein:

said sealing band defines a width along the extent of said sealing band as said sealing band extends along at least said part of said interior facing surface of said skirt, said width possesses a first magnitude at said first circumferential position of said sealing band, said width possesses a second magnitude at said second circumferential position of said sealing band, said second magnitude is greater than said first magnitude, and said width asymptotically increases as said sealing band extends from said first circumferential position to said second circumferential position.

20. The assembly of claim 19, wherein:

said width possesses a third magnitude at a third circumferential position of said sealing band which is spaced apart from said first circumferential position, said second magnitude is greater than said third magnitude, and magnitude of said width asymptotically decreases as said sealing band extends from said second circumferential position to said third circumferential position.

21. The assembly of claim 19, wherein:

said first magnitude of said width is a minimum width of said sealing band, and said second magnitude of said width is a maximum width of said sealing band.

22. The assembly of claim 21, wherein:

0.023 inches<said minimum width of said sealing band<0.035 inches, and 0.085 inches<said maximum width of said sealing band<0.106 inches.

23. The assembly of claim 22, wherein:

said minimum width of said sealing band is equal to about 0.030 inches, and said maximum width of said sealing band is equal to about 0.090 inches.

24. The assembly of claim 19, wherein:

said cover portion defines (i) a first opening, and (ii) a second opening that is larger than said first opening, said first opening is aligned with said first circumferential position of said sealing band, and said second opening is aligned with said second circumferential position of said sealing band.

25. A lid and container assembly, comprising:

a container having a rim portion that defines a container opening; and a lid having (i) a cover portion positioned over said container opening, and (ii) a skirt, wherein said skirt includes (i) a skirt body extending from said cover portion and positioned circumferentially around said rim portion of said container so as to define a skirt body space in which said rim portion of said container is located, and (ii) a sealing band secured to said skirt body and located in said skirt body space, wherein said skirt body defines an interior facing surface and an exterior facing surface, wherein said sealing band extends inwardly from said interior facing surface of said skirt body and is positioned in contact with said rim portion of said container, wherein said sealing band defines a vertex along the extent of said sealing band and said sealing band extends at least 180° so as to at least partially encircle said rim portion of said container, wherein said vertex possesses (i) a first height at a first circumferential position of said sealing band, and (ii) a second height at a second circumferential position of said sealing band, wherein said second height is greater than said first height, wherein said vertex never decreases in height as said sealing band extends from said first circumferential position to said second circumferential position, wherein said sealing band defines a width along the extent of said sealing band as said sealing band, wherein said width possesses a first magnitude at said first circumferential position of said sealing band, wherein said width possesses a second magnitude at said second circumferential position of said sealing band, wherein said second magnitude is greater than said first magnitude, wherein said width never decreases as said sealing band extends from said first circumferential position to said second circumferential position, wherein height of said vertex asymptotically increases as said sealing band extends from said first circumferential position to said second circumferential position, and wherein said width asymptotically increases as said sealing band extends from said first circumferential position to said second circumferential position.

26. The assembly of claim 25, wherein:

said cover portion defines (i) a first opening, and (ii) a second opening that is larger than said first opening, said first opening is aligned with said first circumferential position of said sealing band, and said second opening is aligned with said second circumferential position of said sealing band.

27. The assembly of claim 26, wherein:

said first height of said vertex is a minimum height of said vertex, and said second height of said vertex is a maximum height of said vertex, said first width of said sealing band is a minimum width of said sealing band, and said second width of said sealing band is a maximum width of said sealing band.

28. The assembly of claim 27, wherein:

0.005 inches<said minimum height of said vertex<0.015 inches, 0.025 inches<said maximum height of said vertex<0.035 inches, 0.023 inches<said minimum width of said sealing band<0.035 inches, and 0.085 inches<said maximum width of said sealing band<0.106 inches.

29. The assembly of claim 28, wherein:

said minimum height of said vertex is equal to about 0.010 inches, said maximum height of said vertex is equal to about 0.030 inches, said minimum width of said sealing band is equal to about 0.030 inches, and said maximum width of said sealing band is equal to about 0.101 inches.

30. A lid and container assembly, comprising:

a container having a rim portion that defines a container opening; and a lid having (i) a cover portion positioned over said container opening, and (ii) a skirt, wherein said skirt includes (i) a skirt body extending from said cover portion and positioned circumferentially around said rim portion of said container so as to define a skirt body space in which said rim portion of said container is located, and (ii) a sealing band secured to said skirt body and located in said skirt body space, wherein said skirt body defines an interior facing surface and an exterior facing surface, wherein said sealing band extends inwardly from said interior facing surface of said skirt body and is positioned in contact with said rim portion of said container, wherein said sealing band defines a vertex along the extent of said sealing band and said sealing band extends at least 180° so as to at least partially encircle said rim portion of said container, wherein said vertex possesses (i) a first height at a first circumferential position of said sealing band, and (ii) a second height at a second circumferential position of said sealing band, wherein said second height is greater than said first height, wherein said vertex never decreases in height as said sealing band extends from said first circumferential position to said second circumferential position, and wherein said vertex continuously increases in height as said sealing band extends from said first circumferential position to said second circumferential position.

31. A lid adapted for use with a container having a rim portion that defines a container opening, comprising:

a cover portion, and a skirt including (i) a skirt body extending from said cover portion and defining a skirt body space configured to receive said rim portion of said container therein, and (ii) a sealing band located in said skirt body space, wherein said skirt body defines an interior facing surface and an exterior facing surface, wherein said sealing band is attached to said interior facing surface and extends inwardly from said interior facing surface, wherein said sealing band defines a vertex along the extent of said sealing band and said sealing band extends at least 180° along at least a part of said interior facing surface of said skirt, wherein said vertex possesses (i) a first height at a first circumferential position of said sealing band, and (ii) a second height at a second circumferential position of said sealing band, wherein said second height is greater than said first height, wherein said vertex never decreases in height as said sealing band extends from said first circumferential position to said second circumferential position, wherein said sealing band defines a width along the extent of said sealing band, wherein said width possesses a first magnitude at said first circumferential position of said sealing band, wherein said width possesses a second magnitude at said second circumferential position of said sealing band, wherein said second magnitude is greater than said first magnitude, wherein said width never decreases as said sealing band extends from said first circumferential position to said second circumferential position, wherein height of said vertex asymptotically increases as said sealing band extends from said first circumferential position to said second circumferential position, and wherein said width asymptotically increases as said sealing band extends from said first circumferential position to said second circumferential position.

32. The assembly of claim 31, wherein:

said cover portion defines (i) a first opening, and (ii) a second opening that is larger than said first opening, said first opening is aligned with said first circumferential position of said sealing band, and said second opening is aligned with said second circumferential position of said sealing band.

33. The assembly of claim 32, wherein:

said first height of said vertex is a minimum height of said vertex, said second height of said vertex is a maximum height of said vertex, said first width of said sealing band is a minimum width of said sealing band, and said second width of said sealing band is a maximum width of said sealing band.

34. The assembly of claim 33, wherein:

0.005 inches<said minimum height of said vertex<0.015 inches, 0.025 inches<said maximum height of said vertex<0.035 inches, 0.023 inches<said minimum width of said sealing band<0.035 inches, and 0.085 inches<said maximum width of said sealing band<0.106 inches.

35. The assembly of claim 34, wherein:

said minimum height of said vertex is equal to about 0.010 inches, said maximum height of said vertex is equal to about 0.030 inches, said minimum width of said sealing band is equal to about 0.030 inches, and said maximum width of said sealing band is equal to about 0.090 inches.

36. The assembly of claim 31, wherein:

said vertex continuously increases in height as said sealing band extends from said first circumferential position to said second circumferential position.

37. The assembly of claim 6, wherein said first opening is spaced apart from said second opening by about 180° along the extent of said sealing band.

38. The assembly of claim 18, wherein said first opening is spaced apart from said second opening by about 180° along the extent of said sealing band.

* * * * *